US006115000A

United States Patent [19]

Otomo et al.

[11] Patent Number: 6,115,000

[45] **Date of Patent: *Sep. 5, 2000**

[54] ANTENNA ASSEMBLY COMPRISING WHIP ANTENNA AND HELICAL ANTENNA CONTAINED IN ANTENNA TOP ROTATABLY MOUNTED ON TOP END OF THE WHIP ANTENNA

[75] Inventors: Shinichi Otomo; Kazuo Minegishi, both of Sendai, Japan

[73] Assignee: Tokin Corporation, Miyagi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/114,672

[22] Filed: Jul. 13, 1998

[30] Foreign Application Priority Data

Jul. 16, 1997 [JP] Japan ..... 9-190914

[51] Int. Cl.[7] ..... H01Q 1/24

[52] U.S. Cl. ..... 343/702; 343/895

[58] Field of Search ..... 343/702, 895, 343/906, 900, 901, 715; H01Q 1/24, 1/36

[56] References Cited

U.S. PATENT DOCUMENTS

| | | | |
|---|---|---|---|
| 5,179,387 | 1/1993 | Wells | 343/895 |
| 5,485,170 | 1/1996 | McCarrick | 343/895 |
| 5,521,605 | 5/1996 | Koike | 343/702 |
| 5,596,334 | 1/1997 | Boyce et al. | 343/702 |
| 5,606,327 | 2/1997 | Elliott et al. | 343/702 |
| 5,686,927 | 11/1997 | Simmons | 343/895 |

FOREIGN PATENT DOCUMENTS

| | | |
|---|---|---|
| 0634806 A1 | 1/1995 | European Pat. Off. . |
| 0772255 A1 | 5/1997 | European Pat. Off. . |
| 2308502 | 6/1997 | United Kingdom . |

*Primary Examiner*—Hoanganh Le
*Attorney, Agent, or Firm*—Frishauf, Holtz, Goodman, Langer & Chick, P.C.

[57] ABSTRACT

An antenna assembly (30) includes a whip antenna (11) and an antenna top (12) has a helical antenna (18) and mounted on a top end of the whip antenna. The antenna assembly is slidably mounted on a cellular telephone set (20) and movable between an extended position and a retracted position. The antenna assembly is further provided with a conductor sleeve (32) connected to the helical antenna. In the retracted position, the helical antenna is brought into electrical connected to an electrical circuitry in the telephone set through the conductor sleeve. The conductor sleeve is rotatably mounted but prevented from axial movement on a dielectric joint member (31) fixed on the top end of the whip antenna, but is fixed to the antenna top so that the antenna top is rotatably mounted on the joint member. The antenna top is mounted on the joint member but freely rotated on the joint member.

8 Claims, 2 Drawing Sheets

ANTENNA ASSEMBLY COMPRISING WHIP ANTENNA AND HELICAL ANTENNA CONTAINED IN ANTENNA TOP ROTATABLY MOUNTED ON TOP END OF THE WHIP ANTENNA

BACKGROUND OF THE INVENTION

The present invention relates to an antenna assembly comprising a whip antenna and a helical antenna mounted on a top end of the whip antenna and, in particular, to a mounting structure of the helical antenna to the whip antenna.

In the prior art, an antenna assembly of the type described has been used in a radio communication device such as a portable communication terminal set, especially a mobile telephone terminal set. The antenna assembly is usually extendably and retractably mounted to a casing or a housing of the terminal set as disclosed in JP-A-3 245603 (Reference I).

In Reference I, the terminal set has a housing or enclosure enclosing transmitting and receiving electrical circuitry. The antenna assembly comprises the whip antenna or an antenna rod which is slidably supported in a support mounted to the housing. The support is made of conductor and is connected to the electrical circuitry. The whip antenna is provided with a stopper or a conductive ring fixedly mounted on a lower or an inner end. When the whip antenna is in an extended position, the stopper is brought into contact with the support, so that the whip antenna is connected to the electrical circuitry through the stopper and the support. The whip antenna comprises a conductive rod covered with a dielectric sleeve or sheath. The whip antenna or the conductive rod has an electrical length of a quarter wavelength of a predetermined frequency.

The helical antenna or an antenna coil is enclosed in a dielectric cap and is carried on a top end of the whip antenna. The dielectric cap is provided with a conductive sleeve at a lower end electrically connecting with the helical antenna. The conductive sleeve is fitted onto the top end of the whip antenna and fixed thereto by caulking or deforming the conductive sleeve together with the dielectric sleeve. The helical antenna is connected to the conductive rod and also has an electrical length of a quarter wavelength of the predetermined frequency. Therefore, the antenna assembly has a half wavelength of the predetermined frequency.

When the antenna assembly is in a retracted position, the whip antenna is retracted in the housing with the helical antenna being connected with the electrical circuitry through the conductive sleeve and the support. Thus, the helical antenna is used for short-range operation of the terminal set. In this condition, the whip antenna is in the housing and, therefore, does not serve for receiving a radio signal.

For a long-range operation, the antenna assembly is pulled out by manually handling the cap into the extended position where the stopper is brought into contact with the support. Thus, the antenna assembly serves as a half-wavelength antenna.

An assembly of the helical antenna and the dielectric cap with the conductive sleeve will be referred to as an antenna top.

In order to insure that the whip antenna is disabled when the antenna assembly is in the retracted position, the terminal set may have a coaxial support in which the whip antenna is positioned in the retracted condition. This is disclosed in GB 2,257,836 A (Reference II) and JP-A-5 243829 corresponding thereto.

There is also known in the prior art, for example, U.S. Pat. No. 5,204,687 (Reference III) and JP-B-2646505 (Reference IV) another structure of the antenna assembly where the conductor rod of the whip antenna is not electrically connected with the helical antenna but is insulated therefrom. In the structure, the whip antenna is reliably disabled in the retracted condition without use of a special support structure such as the coaxial structure. The whip antenna only serves for receiving the radio signal in the extended condition because the helical antenna is no longer connected to the support. This structure of the antenna assembly will be referred to as a "separate type", because the whip antenna is electrically separated from the helical antenna.

In detail, Reference IV discloses a dielectric joint member of a generally rod shape which is secured at one end thereof to the top end of the conductor rod of the whip antenna. The joint member is partially covered with the conductive sleeve and is fitted at the other end portion with a coil bobbin. A helical coil or the helical antenna is wound on the coil bobbin and is connected to the conductive sleeve. The dielectric cap covers on the coil bobbin, the helical coil and the top end portion of the conductive sleeve together by, for example, the plastic molding to form the antenna top.

In the above, the conductive sleeve and the top end of the conductive rod of the whip antenna are fixed to the joint member by the insulation molding of the joint member when the conductive sleeve and the top end of the conductive rod are inserted into a mold.

The antenna top is manipulated in an operation for bringing the antenna assembly into the retracted condition or the extended condition. Due to rough handling of the antenna top in the operation or in the habits of users, the antenna top may often be subjected to unusual rotating torque or undue flexural force, so that the antenna assembly is easily broken or cut by twisting at the point near the boundary between the conductive sleeve and the joint member.

SUMMARY OF THE INVENTION

Accordingly, it is an object of the present invention to provide a separate type antenna assembly that eliminates the problems described above and prevents the boundary between the joint member and the conductive sleeve from being twisted and cut off by an accidental rotating torque.

According to the present invention, there is provided an antenna assembly which is movable between an extended position and a retracted position and comprises a whip antenna, a dielectric joint member fixed on a top end of the whip antenna, and an antenna top mounted on the joint member and including a helical antenna and a conductor sleeve connected to the helical antenna for electrical connection of the helical antenna at the retracted position. The antenna assembly is characterized in that the helical antenna is fixedly connected to the conductor sleeve, and the conductor sleeve is rotatably mounted on the joint member but is prevented from axial movement on the joint member.

DESCRIPTION OF THE PREFERRED EMBODIMENT

For better understanding of the present invention, description will be made as to an example of a known antenna assembly according to a prior art by referring to the accompanying drawings.

Figure 1:
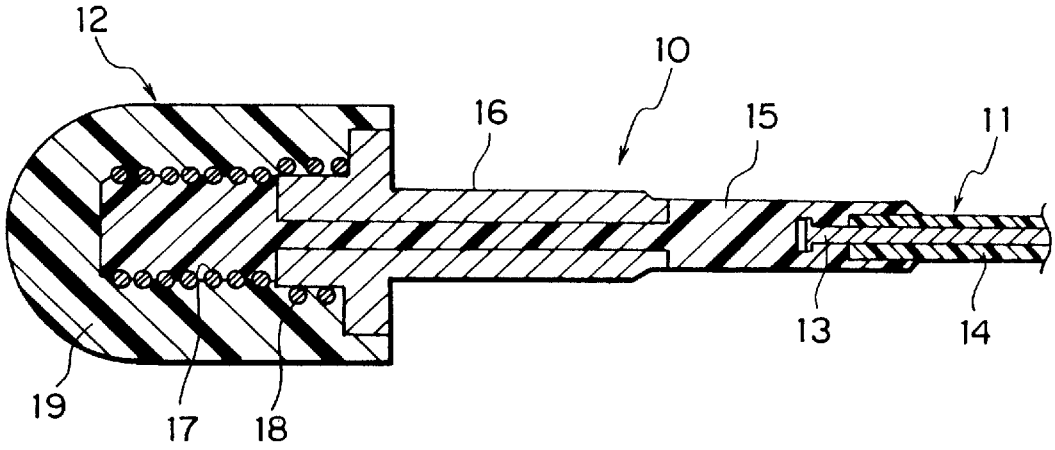
FIG. 1 PRIOR ART
FIG. 1 is a sectional view illustrating a part of a known separate type of antenna assembly.

Referring to FIG. 1, a known separate type of an antenna assembly 10 shown therein comprises a whip antenna 11 (which is partially shown) and an antenna top 12 mounted on one end of the whip antenna.

The whip antenna 11 comprises a conductor rod 13 and a dielectric sleeve 14. On the top end of the conductor rod 13, a joint member 15 of a dielectric rod shape is fixed by the insertion molding. A conductor sleeve 16 is fixed on the outer surface of a middle portion of the joint member 15 by the insertion molding. In the outer surface of a top end portion of the joint member 15, is formed a helical groove 17 in which a helical coil or a helical antenna 18 is disposed. The helical coil 18 is connected to an end portion of the conductor sleeve 16. A dielectric cap 19 covers over the top end portion of the joint member 15, the helical coil 18, and the top end portion of the conductor sleeve 16. The cap 12 is formed in a given shape by, usually, the insertion molding. Thus, the antenna top is formed which comprises the cap 19, the helical antenna 18 and the conductor sleeve integrally connected to each other and fixed to the joint member 15.

In the shown example, the top end potion of the joint member 15 is formed with the helical groove 17 in which the helical coil 18 is directly wound. Therefore, the top end portion of the joint member 15 will be often referred to as coil guide portion. However, the top end portion of the joint member 15 is not formed with the helical groove but may be mounted thereon a coil bobbin having a helical groove in which the helical coil is wound. The structure is shown in Reference IV.

Figure 2:
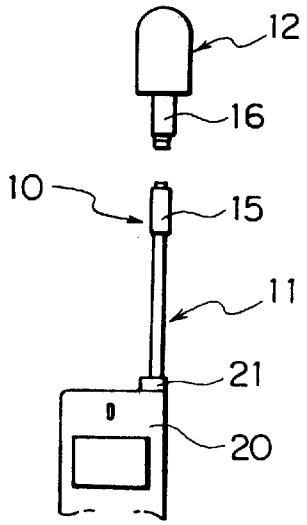
FIG. 2 PRIOR ART
FIG. 2 is a front view of a terminal set with the antenna assembly of FIG. 1 but being broken at boundary between a conductive sleeve and a dielectric joint member.

Referring to FIG. 2, the known antenna assembly 10 of FIG. 1 is slidably supported in a conductive support 21 mounted in a housing of a terminal set or a Cellular telephone set 20, as disclosed in References I–IV. In use of the terminal set 20, the antenna assembly 10 is moved into the extended position or the retracted position by manipulating the antenna top. However, the antenna assembly 10 often suffered from the problem that the antenna top 12 was separated from the antenna assembly by cutting off at a point near the boundary between the conductor sleeve 16 and the joint member 15 due to an undue torque applied to the antenna top 12, as illustrated in FIG. 2.

A preferred embodiment of the present invention will now be described with reference to FIGS. 3 and 4.

Figure 3:
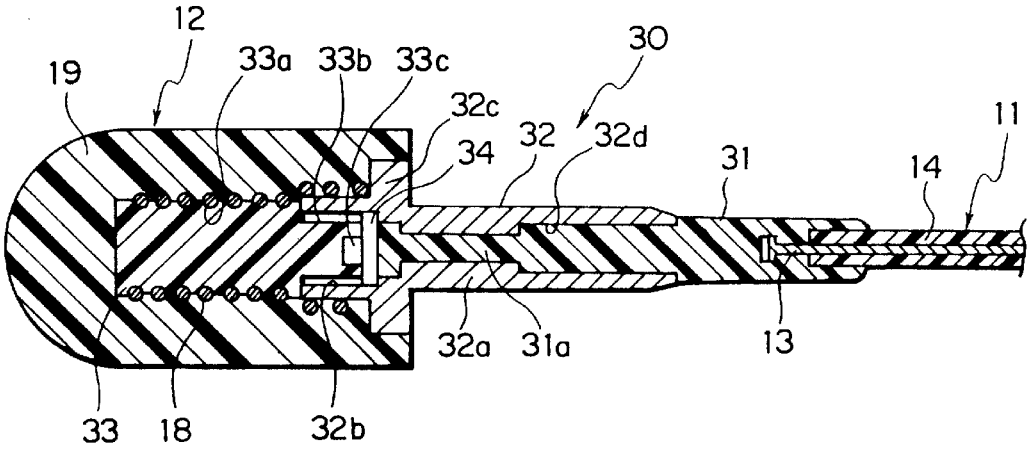
FIG. 3 is a sectional view of a part of a separate type of antenna assembly according to an embodiment of the present invention.

As shown in FIG. 3, the antenna assembly 30 of a separate type according to the embodiment of the present invention shown therein is similar to the known one shown in FIG. 1 except with respect to the structures of antenna top and joint member. Therefore, similar parts are shown by the same reference numerals in FIG. 1 and description thereto is omitted for the purpose of simplification of the description.

A joint member 31 of a dielectric substance such as plastic resin, for example, polyamide, is fixed onto a top end of the conductor rod 13 of the whip antenna 11. A conductor sleeve 32 is rotatably mounted on the outer surface of the joint member 31 but is prevented from axial movement on the joint member 31, because the conductor sleeve 32 has an inner rim portion 32*a* fitted into a reduced diameter portion 31*a* of the joint member 31.

The joint member 31 extends in the conductor sleeve 32 but is short of the top end of the conductor sleeve 32 so that the conductor sleeve 32 has a space at the top end portion. A female thread 32*b* is formed in an inner wall of the top end portion of the conductor sleeve 32.

The conductor sleeve 32 has an annular outer flange 32*c* at a position adjacent but short of the top end. The inner rib 32*a* is formed at an axial position of the outer flange 32*c* and axially extends from the position rearward. The conductor sleeve 32 is also provided with an increased diameter bore 32*d* at the rear portion which has an axial length about a half length of the conductor sleeve 32. The joint member 31 has an outer shape corresponding to the inner shape of the conductor sleeve 32. This structure of the conductor sleeve 32 and the joint member 31 insures a mechanical strength in the vicinity of the outer flange 32*c* of the conductor sleeve 32 and the joint member 31 at the boundary between the conductor sleeve and the joint member 31.

A coil guide member 33 of a dielectric substance having the helical coil 18 in a helical groove 33*a* formed thereon is fixed on to the top end portion of the conductor sleeve 32. In detail, the coil guide member 33 is formed with a male thread 33*b*, which is engaged with the female thread 32*b* of the conductor sleeve 32. A top end of the joint member 31 faces an end of the coil guide member 33 in the space of the top end portion of the conductor sleeve 32 with a small axial gap 34. The helical coil 18 is connected to the conductor sleeve 32.

The coil guide member 33 may be fixed to the conductor sleeve 32 by any suitable adhesive agent with or without the engagement of the male and female threads 33*b* and 32*b*. Alternatively, the coil guide member 33 can be press-fitted or closely fitted into the space of the top end portion of the conductor sleeve 32.

The dielectric cap 19 is formed into a given shape by the insulation molding to cover the coil guide member 33, the helical coil 18 and the top end portion of the conductor sleeve 32 together. Thus, the helical coil 18, the conductor sleeve 32, and the coil guide member 33 are integrally connected by the cap 19 to form the antenna top 12, which is rotatably mounted onto the joint member 31.

In production of the antenna assembly 30, the conductor rod 13 and the conductor sleeve 32 are prepared, while the coil guide member 33 is formed and wound with the helical coil 18 thereon. Thereafter, the conductor sleeve 32 and the conductor rod 13 are inserted in a mold and the joint member 31 is formed. That is, the joint member 31 is formed by the insertion molding together with the conductor sleeve 32 and the conductor rod 13. Thus, the joint member 31 is fixed to the top end of the conductor rod 13 and to the conductor sleeve 32. The top end of the conductor rod 13 is preferably provided with an increased diameter portion as shown in FIG. 3 so as to fixedly retain the joint member 31 on to the conductor rod 13. The coil guide member 33 with the helical coil 18 is fixed to the conductor sleeve 32 and then the cap 19 is formed to form the antenna top 12. After completion of the insertion molding, the conductor sleeve 32 is twisted and then becomes rotatable on the joint member 31. It is preferable to apply any mold releasing agent on the inner surface before the insulation molding. Thus, the antenna top 12 is rotatable on the joint member 31.

The axial gap 32*c* is formed in the insertion molding where the molding material or the plastic resin is injected through the gap as a gate. The coil guide member 33 can previously be provided with a small hollow space for the gate shown at 33*c* in FIG. 3 in the end surface thereof, if it is desired.

Figure 4:
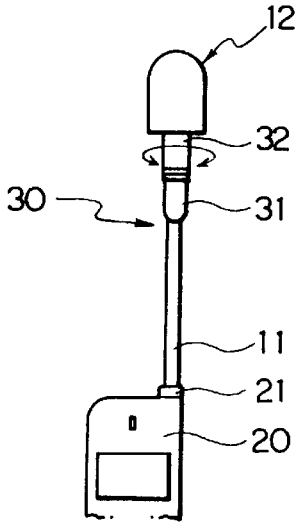
FIG. 4 is a front view of the terminal set using the antenna assembly of FIG. 3 showing that an antenna top is rotatable.

Referring to FIG. 4, the antenna assembly 30 is mounted on a terminal set 20 in the similar manner as in FIG. 2. The antenna assembly 30 is shown in the extended position. The antenna top 12 is manipulated but is rotatable on the joint member 31 as shown at the arrow. This is because the conductor sleeve 32 is rotatably mounted on the joint member 31. Therefore, the antenna assembly is prevented from being broken at the boundary between the joint member 31 and the conductor sleeve 32 even if the antenna top 12 is rotated on the whip antenna 11 by a large torque.

Thus, the present invention makes it possible to vide a separate type of antenna assembly which is free of breakage under a large torque applied to the antenna top.

What is claimed is:

1. An antenna assembly movable between an extended position and a retracted position, said antenna assembly comprising:

a whip antenna, a dielectric joint member fixed on a top end of the whip antenna, and an antenna top mounted on the joint member and including a helical antenna and a conductor sleeve connected to the helical antenna for electrical feeding of the helical antenna at the retracted position, wherein said helical antenna is fixedly connected to said conductor sleeve, and said conductor sleeve is mounted on said joint member to be rotatable without axial movement thereon relative to said joint member.

2. An antenna assembly according to claim 1, wherein said antenna top comprises a coil guide member having said helical antenna wound thereon, and said coil guide member is fixed to said conductor sleeve.

3. An antenna according to claim 2, wherein said joint member extends in said conductor sleeve short of an end of the conductor sleeve, and said coil guide member is fitted into said conductor sleeve through said end of the conductor sleeve and faces a top end of said joint member with a small gap therebetween.

4. An antenna according to claim 3, wherein one end of said coil guide member is closely fitted into said end of said conductor sleeve.

5. An antenna according to claim 3, wherein one end of said coil guide member is provided with a male thread, said end of said conductor sleeve is provided with a female thread, and said coil guide member and said conductor sleeve are fixed to each other by engagement of said male thread and said female thread.

6. An antenna according to claim 3, wherein one end of said coil guide member and said end of said conductor sleeve are fixed by an adhesive agent.

7. An antenna according to claim 1, wherein said conductor sleeve is provided with an inner rim, said inner rim engaging with a corresponding decreased diameter portion of said joint member so that said conductor sleeve is prevented from axial movement on said joint member.

8. An antenna according to claim 7, wherein said joint member is made of polyamide and formed by insertion molding together with said whip antenna and said conductor sleeve.

* * * * *